US009923325B2

(12) United States Patent
Jansen et al.

(10) Patent No.: US 9,923,325 B2
(45) Date of Patent: Mar. 20, 2018

(54) END CAP FOR A TUBULAR LIGHT SOURCE

(71) Applicant: PHILIPS LIGHTING HOLDINGS B.V., Eindhoven (NL)

(72) Inventors: Martijn Evert Paul Jansen, Eindhoven (NL); Hongwu Wang, Shanghai (CN); Mark Johannes Antonius Verhoeven, Deurne (NL); Liang Zhou, Shanghai (CN); Vincent Stefan David Gielen, Eindhoven (NL); Peter Johannes Martinus Bukkems, Deurne (NL); Georges Marie Calon, Eindhoven (NL); Reinier Imre Anton Den Boer, Eindhoven (NL); Eugen Jacob De Mol, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 19 days.

(21) Appl. No.: 14/762,478

(22) PCT Filed: Jan. 7, 2014

(86) PCT No.: PCT/IB2014/058082

§ 371 (c)(1),
(2) Date: Jul. 22, 2015

(87) PCT Pub. No.: WO2014/115045

PCT Pub. Date: Jul. 31, 2014

(65) Prior Publication Data

US 2015/0364886 A1 Dec. 17, 2015

Related U.S. Application Data

(60) Provisional application No. 61/756,240, filed on Jan. 24, 2013.

(51) Int. Cl.
*F21V 25/04* (2006.01)
*H01R 33/96* (2006.01)
(Continued)

(52) U.S. Cl.
CPC ..... *H01R 33/96* (2013.01); *F21K 9/27* (2016.08); *F21K 9/272* (2016.08); *F21V 21/002* (2013.01);
(Continued)

(58) Field of Classification Search
CPC ..... F21V 25/04; F21V 23/04; F21V 23/06; H01R 33/96; H01R 13/701
(Continued)

(56) References Cited

U.S. PATENT DOCUMENTS 5,412,550 A * 5/1995 Hsieh ..... F21S 8/035 362/641
7,488,086 B2 * 2/2009 Wu ..... F21V 19/008 362/225
(Continued)

FOREIGN PATENT DOCUMENTS

CN 101737664 A 6/2010
CN 201535456 U 7/2010
(Continued)

*Primary Examiner* — Christopher Raabe
(74) *Attorney, Agent, or Firm* — Akarsh P. Belagodu

(57) ABSTRACT

The present invention relates to an end cap (104) for a tubular light source the tubular light source configured to be arranged in a lighting fixture comprising a socket, wherein the end cap (104) comprises a housing portion having a connection end, two connector pins (116) at least partly arranged on an outside of the housing portion at the connection end, wherein the connector pins (116) are configured to fit in the sockets of the lighting fixture, a first spring loaded switching element (110) configured to be alternately positioned in an actuated state and a non-actuated state,
(Continued)

wherein the first spring loaded switching element (110) protrudes at the connection end of the housing portion in the vicinity of the connector pins (116) when positioned in its non-actuated state, and a second spring loaded switching element (112) configured to be positioned in an actuated state and a non-actuated state, wherein the switching elements (110, 112) are configured to be individually positioned in their respective actuated states to form an electrical connection between the socket and the tubular light source when the end cap (104) is mounted into the socket of the fixture.

15 Claims, 8 Drawing Sheets

(51) Int. Cl.

| | |
|---|---|
| ***H01R 33/94*** | (2006.01) |
| ***F21V 21/002*** | (2006.01) |
| ***F21V 23/04*** | (2006.01) |
| ***F21V 23/06*** | (2006.01) |
| ***H01R 13/70*** | (2006.01) |
| ***F21K 9/27*** | (2016.01) |
| ***F21K 9/272*** | (2016.01) |
| *F21Y 103/10* | (2016.01) |
| *F21Y 115/10* | (2016.01) |

(52) U.S. Cl.
CPC ..... *F21V 23/04* (2013.01); *F21V 23/06* (2013.01); *F21V 25/04* (2013.01); *H01R 13/701* (2013.01); *H01R 33/942* (2013.01); *F21Y 2103/10* (2016.08); *F21Y 2115/10* (2016.08)

(58) Field of Classification Search
USPC ..... 362/221
See application file for complete search history.

(56) References Cited

U.S. PATENT DOCUMENTS

| | | | | |
|---|---|---|---|---|
| 8,147,091 | B2 | 4/2012 | Hsia et al. | |
| 2003/0174498 | A1* | 9/2003 | Giannopoulos ..... | H01R 33/942 362/652 |
| 2010/0018178 | A1 | 1/2010 | Fink et al. | |
| 2012/0043892 | A1* | 2/2012 | Visser ..... | F21V 25/04 315/121 |
| 2012/0051040 | A1 | 3/2012 | Hsia et al. | |
| 2012/0099322 | A1* | 4/2012 | Simon ..... | F21K 9/175 362/249.02 |
| 2012/0106157 | A1 | 5/2012 | Simon et al. | |
| 2012/0155074 | A1 | 6/2012 | Mori et al. | |
| 2012/0300445 | A1* | 11/2012 | Chu ..... | F21V 25/04 362/217.13 |
| 2013/0021809 | A1* | 1/2013 | Dellian ..... | H01R 33/96 362/457 |
| 2013/0127327 | A1* | 5/2013 | Heil ..... | F21V 25/04 313/313 |
| 2014/0003054 | A1* | 1/2014 | Simon ..... | F21V 25/04 362/249.05 |
| 2014/0355261 | A1* | 12/2014 | Dingemans ..... | F21V 25/04 362/217.17 |

FOREIGN PATENT DOCUMENTS

| | | | |
|---|---|---|---|
| CN | 201902951 | U | 7/2011 |
| DE | 2717356 | A1 | 10/1978 |
| DE | 102010019875 | A1 | 11/2011 |
| JP | 2010192229 | A | 9/2010 |
| JP | 2010192242 | A | 9/2010 |
| WO | 9910955 | A1 | 3/1999 |
| WO | 2009143047 | A2 | 11/2009 |
| WO | 2011138141 | A2 | 11/2011 |
| WO | 2012010995 | A1 | 1/2012 |

* cited by examiner

END CAP FOR A TUBULAR LIGHT SOURCE

CROSS-REFERENCE TO PRIOR APPLICATIONS

This application is the U.S. National Phase application under 35 U.S.C. §371 of International Application No. PCT/IB2014/058082, filed on Jan. 7, 2014, which claims the benefit of U.S. Provisional Patent Application No. 61/756,240, filed on Jan. 24, 2013. These applications are hereby incorporated by reference herein.

TECHNICAL FIELD

The present invention relates to an end cap for a tubular light source, and in particular to an end cap enabling safe installation of such a tubular light source.

BACKGROUND OF THE INVENTION

Fluorescent lighting tubes are commonly used in a large range of lighting systems as a result of advantages such as longer life time and better luminous efficiency compared to incandescent lamps. However, in the continuous effort to reduce power consumption, it is desirable to replace conventional light tubes with still more energy efficient and environmental friendly alternatives. One such alternative is to use LED tubular light sources having a plurality of LED's arranged in a tube similar to the fluorescent tube. In order to facilitate a transition from fluorescent tube lights to LED based tubular light sources, the LED tubular light sources should be configured for allowing installation in already existing fixtures for fluorescent light tubes. However, the electrical circuitry is different in an LED based tubular light source compared to in a fluorescent light tube in that the LED based tubular light source may provide a current path between the two end caps. Hence, the internal circuitry of the tubular light source is arranged in such a way that the light source may provide an electrical connection between the connector pins at one end portion of an elongated tube and the connector pins at the opposite end portion of the elongated tube even if the light source is not active, contrary to what was possible in conventional fluorescent light tubes. In other words, it is possible that by mounting one end cap of the tubular light source in the socket of the lighting fixture, the internal circuitry will lead live voltage to the connector pins in the opposite end cap. As a result, installation of retrofitted LED tubular light sources may be a safety hazard as it is possible to first install one end cap in the mains connected fixture while having the other end cap still exposed and carrying a live potential on the connection pins of the exposed cap. Thus, there is a risk that the installer touches the exposed end cap and receives an electrical shock.

US2010/018178 discloses a suggestion on how the aforementioned safety issue may be alleviated by introducing a safety switch within the end cap of the LED tubular light source. However, a safety switch according to US2010/018178 may in some cases be unintentionally engaged when the installer is inserting the first end of the tubular light source while having already inserted the second end into the fixture, thereby still exposing the installer to potential hazard as the unconnected end cap may then have a live potential. Accordingly, there is a need for an improved safety mechanism to increase the safety for the installer when installing retrofitted LED tubular light sources.

SUMMARY OF THE INVENTION

In view of the above, an object of the invention is to solve, or at least reduce, the drawback discussed above. Generally, the above object is achieved by the attached independent patent claims.

According to a first aspect of the invention, there is provided an end cap for a tubular light source, the tubular light source configured to be arranged in a lighting fixture comprising a socket, wherein the end cap comprises a housing portion having a connection end, two connector pins at least partly arranged on an outside of the housing portion at the connection end, wherein the connector pins are configured to fit in the socket of the lighting fixture, a first spring loaded switching element configured to be alternately positioned in an actuated state and a non-actuated state, wherein the first spring loaded switching element protrudes at the connection end of the housing portion in the vicinity of the connector pins when positioned in its non-actuated state, and a second spring loaded switching element configured to be positioned in an actuated state and a non-actuated state, wherein the switching elements are configured to be individually positioned in their respective actuated states to form an electrical connection between the socket and the tubular light source when the end cap is mounted into the socket of the fixture.

The present invention is based on the idea of providing an end cap for a tubular light source having double safety mechanisms, i.e. using a pair of spring loaded switching elements, which both must be individually actuated before electricity can be provided from the socket into the light source. According to the present invention, to prevent this problem, both safety mechanisms must be actuated in the unconnected end before the connector pins will carry a live voltage. An advantage of the present invention is that double safety mechanisms may reduce the risk of accidently form such an electrical connection and thus also reduce the risk of exposing the installer to the potential hazard of receiving an electrical shock through an unconnected end cap. A further advantage of the end cap according to the present invention is that spring loaded switching elements may increase safety during installation and un-installation in comparison to prior art solutions, since the springs may more or less automatically return the switching elements to their non-actuated states during un-installation. The spring loaded switching elements determine whether an electronic connection is made between the pins on one side of the tubular light source and the pins on the other side of the tubular light source. The protruding first spring loaded switching element is, in an exemplary embodiment, designed and configured to be depressed when mounted in the intended fixture. The function of a mechanical solution, such as is provided by means of the pair of spring loaded switching elements, is not dependent of a ballast type, in comparison to employing a circuitry based approach of a safety arrangement, and may comply with the different sockets that are used in current fixtures. As such, the shape of the mechanical solution should comply with all mechanical constraints provided by the lamp holders and the standard outline of the lamp. Moreover, since the switching elements are spring loaded, a certain pressure is required to actuate the switching elements. This may also reduce the risk of accidently actuating the switching elements.

According to another embodiment of the present invention, the first and second spring loaded switching elements are arranged in their actuated states by applying a translational force onto a front portion of the first and the second spring loaded switching element, respectively.

By the term "front portion" should, in the context of the present specification, be understood to relate to a portion of the switching element accessible for an installer of the tubular light source. The front portion may for example be a portion of the switching element protruding through the housing portion of the end cap or it may be a portion of the switching element accessible through a hole in the housing portion.

By the term "translational force" should, in the context of present specification, be understood to relate to a force that produces movement of the switching element in a non-rotational direction.

A further advantage is that a simple way of actuating a switching element is provided, which may not require any particular skill or knowledge when installing the tubular light source. A still further advantage is that the first switching element may be automatically actuated when installing the end cap in the socket since the socket will apply the needed force on the protruding part, i.e. front portion, of the first switching element when inserted therein. By having a switch which only closes an electrical circuit when the connector pins are out of reach for the installer significantly reduces the risk for the installer of receiving an electrical shock when installing the tubular light source.

Further, the first switching element may be configured to return to its non-actuated state when no translational force is applied onto its front portion. This may be advantageous when un-installing the tubular light source. In this case, the electrical connection between the connector pins at a side which is still connected to a socket and the connector pins at the unconnected end cap is interrupted as soon as the translational force of the first spring loaded switching element is removed, e.g. as soon as the end cap is removed from the socket.

According to yet another embodiment of the present invention, the front portion of at least one of the switching elements has an arrow shaped configuration. This is advantageous in the case of a switching element configured to be automatically actuated when mounting the end cap into the socket. The arrow shaped configuration may, for example, transform a non-translational component of the force from the socket onto the switching element into a translational force, which in turn will actuate the switching element. In a further embodiment, the edges of the front portion is made sharp, which may further reduces the risk of having an installer accidently actuating the switching element manually since the sharp edges may cause pain to the installer if she/he manually pushes the front portion.

In another embodiment of the present invention, the front portion of the second spring loaded switching element protrudes at the connection end of the housing portion in the vicinity of the connector pins when in its non-actuated state. The protruding second spring loaded switching element is preferably designed and configured to be depressed when mounted in the intended fixture. Accordingly, the switching elements are configured to be actuated by means of mounting the tubular light source into the socket of the fixture. An advantage is that the installer of the tubular light source does not have to push any of the switching elements manually; the socket will actuate both switching elements when the light source is mounted. Hereby, the risk of receiving an electrical shock is further reduced since the connector pins are out of reach for the installer.

Furthermore, the second switching element may be configured to return to its non-actuated state when no translational force is applied onto its front portion. This may be advantageous when un-installing the tubular light source. In this case, the electrical connection between the connector pins at one side still connected to a socket and the connector pins at the unconnected end cap is interrupted as soon as the translational force of the second spring loaded switching element is interrupted as soon as the translational force of the first spring loaded switching element is removed, e.g. as soon as the end cap is removed from the socket. The interruption may occur automatically when un-installing the tubular light source which may reduce the risk of exposing the installer to the potential hazard of receiving an electrical shock through an unconnected end cap According to yet another embodiment of the present invention, the end cap further comprising: a first fixed tongue connected to a first of the two connector pins; a second fixed tongue connected to a second of the two connector pins; a base plate connected to a first and a second resilient tongue, the first resilient tongue being arranged to abut the first fixed tongue and the second resilient tongue being arranged to abut the second fixed tongue to complete a conductive path between the first resilient tongue and the first connector pin and between the second resilient tongue and the second connector pin, respectively, when both of the two spring loaded switching elements are in the actuated state; wherein each of the two spring loaded switching elements comprising a first and a second separating element, wherein the first and second separating elements of each of the two spring loaded switching elements, in the non-actuated state, is individually arranged to separate both the first fixed tongue from the first resilient tongue and the second fixed tongue from the second resilient tongue, respectively, thus opening the conductive path between the resilient tongues and the connector pins.

This embodiment may be a simple mechanical solution to the double safety mechanisms that may reduce the risk of accidently form an electrical connection and thus also reduce the risk of exposing the installer to the potential hazard of receiving an electrical shock through an unconnected end cap. An advantage of this embodiment is that the production cost may be lowered. Moreover, a reliable end cap is provided.

According to a further embodiment, the first spring loaded switching element further comprises a lock mechanism preventing the first spring loaded switching element from being actuated and wherein actuation of the second spring loaded switching element unlocks the lock mechanism allowing the first spring loaded switching element to be actuated. Hereby, the first spring loaded switching element cannot be actuated unless the second spring loaded switching element has been previously actuated. In other words, the switching elements in this embodiment must be actuated in a pre-defined order which may further reduce the risk of exposing the installer to the hazard of getting an electrical shock through an unconnected end cap.

According to another embodiment, the electrical connection between the socket and the tubular light source may be formed by actuating the second spring loaded switching element while inserting the connector pins of the tubular light source into the socket of the fixture.

According to yet another embodiment, de-actuating the first spring loaded switching element may de-actuate the second spring loaded switching element. An advantage of this is that the second spring loaded switching element may remain actuated as long as the first spring loaded switching element is actuated. On the other way around, when installing the tubular light source, manual actuation of the second switching element is only necessary until the first switching element is actuated, i.e. the installer of the tubular light source can stop pushing the second switching element as soon as the light source is mounted in the socket.

Furthermore, the above described end cap may preferably be arranged in a tubular light source, wherein the tubular light source further comprises a lighting tube comprising a plurality of light emitting elements. Effects and features of the tubular light source are largely analogous to those described above.

The light source may further comprise warning means, the warning means comprises a blinking light positioned onto the at least one end cap. Additionally or alternatively, the warning means may be a text warning or a symbol warning. The warning means may be urging an installer to be careful when mounting the light source. The warning means, e.g. the text warning or the symbol warning, may be visible at all time. Moreover, the warning means, e.g. the blinking light, may be visible only when there is a risk of receiving an electrical shock. This is advantageous since the warning may be visible only when there is a real danger for receiving a shock, for example when one end cap of a tubular light source is connected to the socket and the other end cap is un-connected.

Moreover, the light source may comprise a relay which in combination with the switching elements enables operation of the tubular light source when mounted in the lighting fixture. The light source may also comprise a timer which in combination with the switching elements enables operation of the tubular light source when mounted in the lighting fixture. The relay or timer is thus a further safety mechanism for reducing the risk of exposing the installer of the light source to the potential hazard of receiving an electrical shock through an unconnected end cap in the case that the safety mechanism in the unconnected end cap is failing. The timer or relay may prevent electricity from being transmitted from one side of the tubular light source to the other for some predefined time interval.

It is noted that the invention relates to all possible combinations of features recited in the claims. Generally, all terms used in the claims are to be interpreted according to their ordinary meaning in the technical field unless explicitly defined otherwise herein.

Other objectives, features and advantages of the present invention will appear from the following detailed disclosure as well as from the drawings.

BRIEF DESCRIPTION OF THE DRAWINGS

This and other aspects of the present invention will now be described in more detail, with reference to the appended drawings showing embodiments of the invention, wherein.

DETAILED DESCRIPTION

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

Figure 1A:
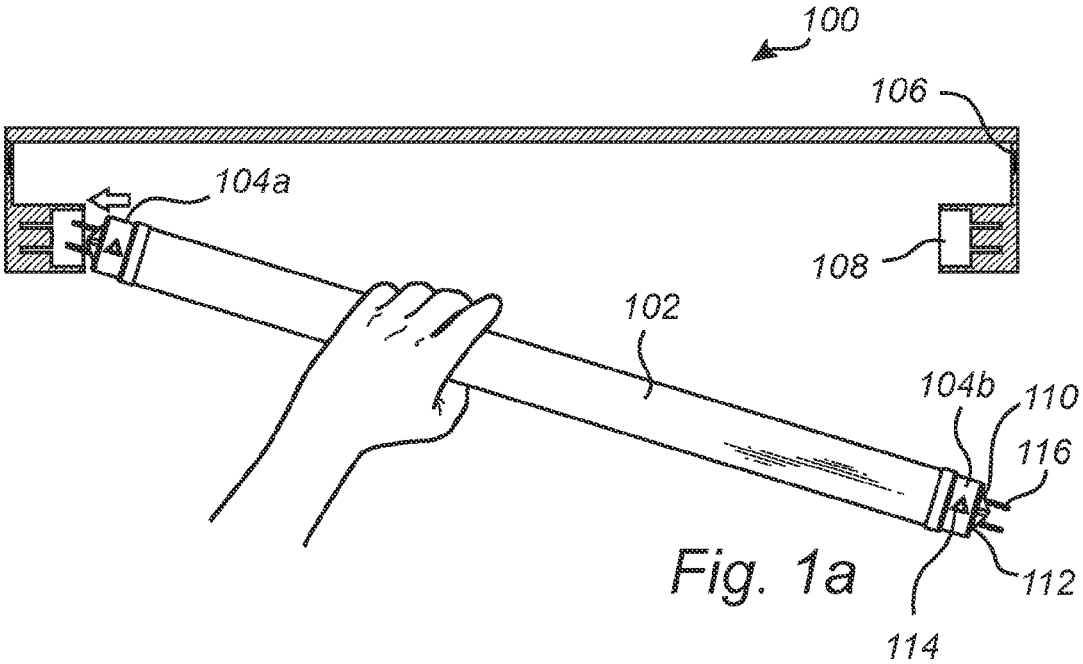
FIGS. 1*a* to 1*b* schematically illustrating an exemplary mounting procedure of a tubular light source having an end cap according to the present invention.

FIG. 1*a* schematically illustrates a luminaire 100 wherein a tubular light source 102 comprising two end caps 104*a*, 104*b* of the same sort according to an embodiment of the present invention is being mounted into a mains connected fixture 106. As illustrated in FIG. 1*a*, one end cap 104*a* is first inserted into a socket 108 arranged in the fixture 106, thereby depressing and actuating a first and a second spring loaded switching element 110, 112 arranged on the outside of the end cap 104*a*. In this state, when one end cap 104*a* of the tubular light source is inserted in the fixture while an opposite end cap 104*b* is still reachable by an installer of the tubular light source, the installer would be exposed to the potential hazard of receiving an electrical shock through the unconnected end cap 104*b* if the connector pins 116 carries live voltage. According to the present invention, both safety mechanisms must be actuated in the unconnected end cap 104*b* before the connector pins 116 will carry live voltage, thus reducing the risk for the installer to receive an electrical shock.

Figure 1B:
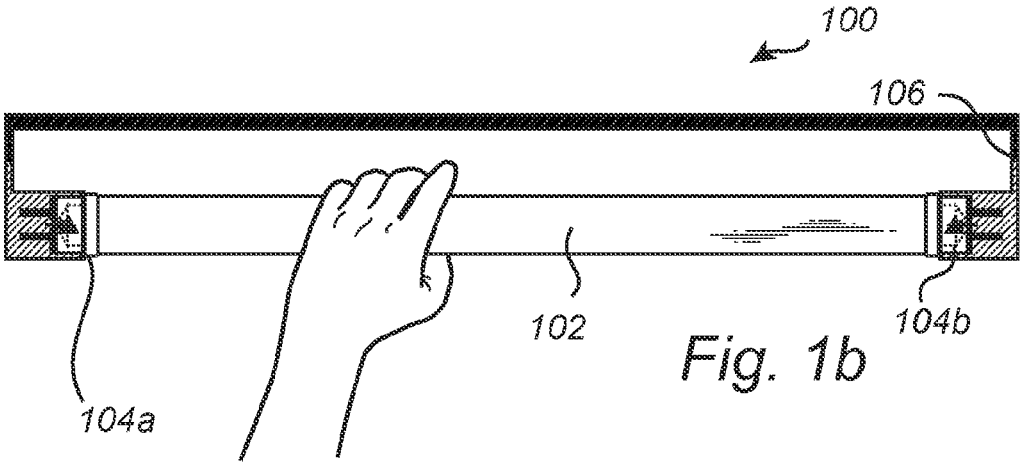

Next, as depicted in FIG. 1*b*, the opposing second end cap 104*b* of the tubular light source 102 is inserted into an opposing socket 108, thereby depressing and actuating a first and a second spring loaded switching element 110, 112 arranged on the outside of the second end cap 104*b*. Both the first and the second switching elements 110, 112 of both end caps 104*a*, 104*b* must be depressed and thereby actuated to engage the electrical circuit of the luminaire and thereby allowing the luminaire to be lit.

The two switching elements 110, 112 are individually operated, e.g. the installer cannot depress both elements 110, 112 by one finger at the same time. This further reduces the risk of the installer accidentally depressing both switching elements.

The end caps 104*a*, 104*b* further comprise, in the illustrated embodiment, a symbol warning arrangement 114 warning the installer of the risk of receiving an electrical shock through an unconnected end cap. This may further reduce the risk that the installer accidentally depresses both switching elements 110, 112.

Additionally, the tubular light source may advantageously comprise light emitting elements and optics configured to mix light from the light emitting elements. Such optics may be any mixing and/or collimating means. Light mixing optics may advantageously be used if the light emitting elements comprise LEDs. However, the light emitting elements may be any light source such as a fluorescent or incandescent light source.

Figure 2A:
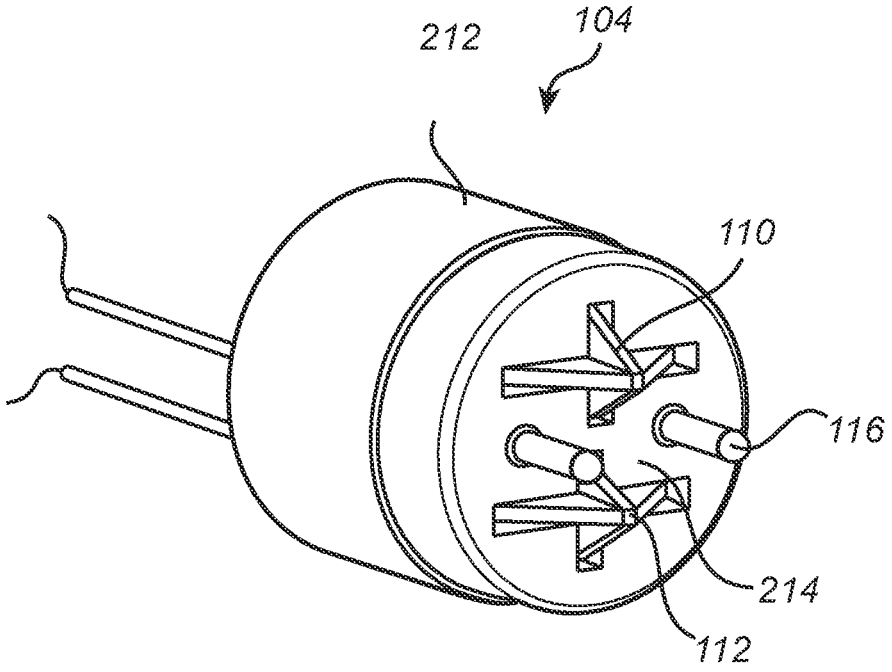
FIGS. 2*a* to 2*d* schematically illustrate an end cap for a tubular light source according to an exemplary embodiment of the invention.
Figure 2D:
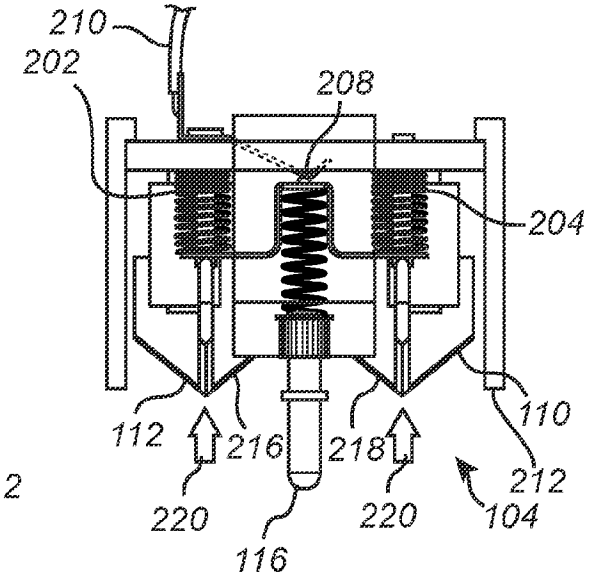
Figure 2C:
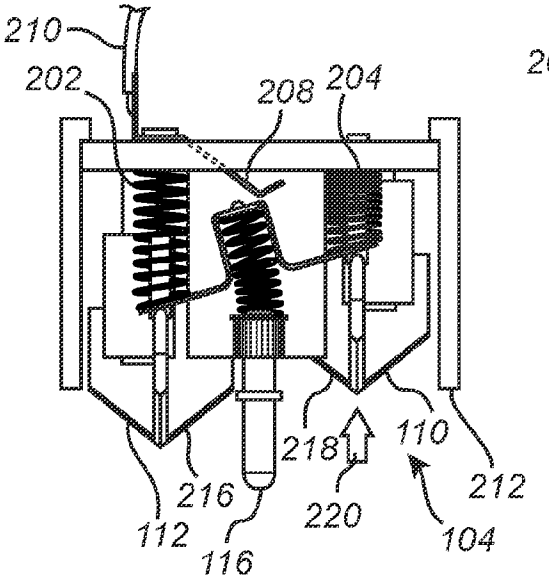
Figure 2B:
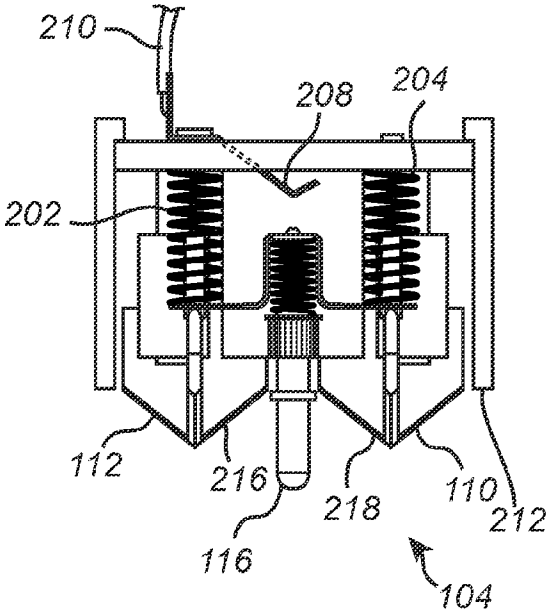

FIGS. 2*a* to 2*d* schematically illustrate an exemplary end cap 104 according to the present invention. The end cap 104 corresponds to the above mentioned end caps 104*a*, 104*b*. An example embodiment will now be described with reference to FIG. 2*a* showing a perspective view of the end cap 104 in conjunction with FIGS. 2*b* to 2*d* showing cross section views of the end cap 104.

The end cap comprises a first 110 and a second 112 spring loaded switching element which both must be depressed and thereby actuated before the connector pins 116 is in contact with a conductive receiving means 208 which in turn is connected to the tubular light source, thereby forming a conductive path between the connector pins 116 and the connected tubular light source via a wire 210. The switching elements 110, 112 protrudes at the connection end 214 of a housing portion 212 of the end cap 104 in the vicinity of the connector pins 116, when being arranged in a non-actuated state. The switching elements 110, 112 are depressed by applying a translational force 220 to a front portion 216, 218 of the switching elements 110, 112. The arrow shaped configuration of the switching elements 110, 112 transforms an applied non-translational force onto the switching element 110, 112 into a translational force which in turn will actuate the switching element 110, 112. The housing portion 212 of the end cap 104 can be made of plastic or metal having an electrical insulation.

The mechanics of the end cap is based on the seesaw principle and has three different configurations depicted in FIGS. 2*b* to 2*d*. FIG. 2*b* shows the state where none of the two switching elements 110, 112 are depressed. In FIG. 2*b* there is no contact between the connector pins 116 and the conductive receiving means 208.

FIG. 2*c* shows the state where the first switching element 110 is depressed by a translational force, indicated by the arrow 220, while the second switching element 112 is in its non-actuated rest position. Also, in FIG. 2*b* there is no contact between the connector pins 116 and the conducting receiving means 208. This naturally also applies to the case when the second switching element 112 is depressed while the first switching element 110 is in its rest position, i.e. non-actuated state.

Finally, FIG. 2*d* shows the state where both the first 110 and the second 112 switching elements are depressed by a translational force, indicated by the arrows 220. Hereby there is contact between the connector pins 116 and the conducting receiving means 208 and thus electricity can be transmitted from the connector pins 116 to the connected tubular light source via the wire 210. The depression, i.e. actuation, of the first 110 and the second 112 switching elements may be executed simultaneously or sequentially.

By using spring loaded switching elements 110, 112, the switching elements are returned to their, non-actuated, rest position as soon as no pressure is applied to them. The springs 202, 204 of the switching elements 110, 112 may be coil springs, leaf springs, elastic elements or any similar structure.

Figure 3A:
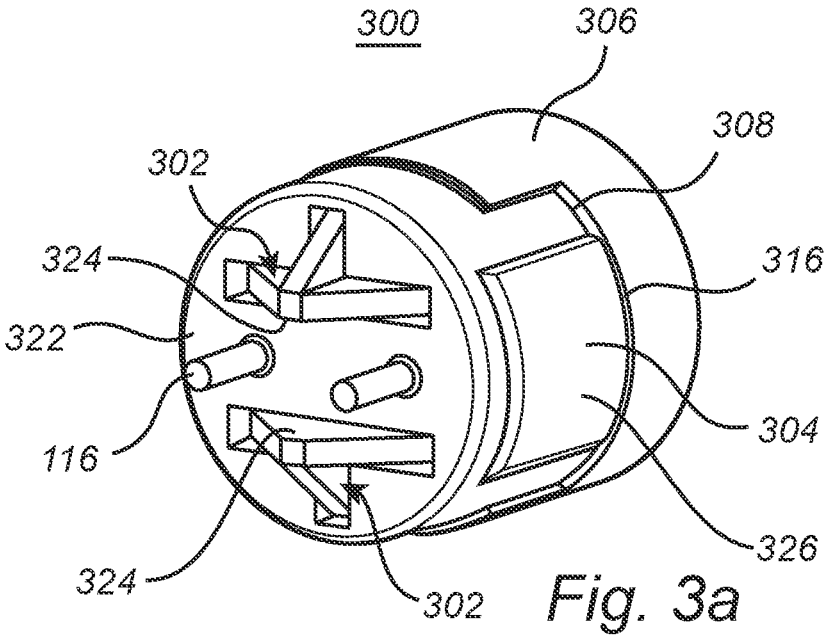
FIGS. 3*a* to 3*d* schematically illustrate an end cap for a tubular light source according to another exemplary embodiment of the invention.

Reference is now made to FIGS. 3*a* to 3*d*, which schematically illustrates another exemplary end cap 300 according to an embodiment of the present invention. FIG. 3*a* illustrating another example embodiment of an end cap 300 according to the present invention. The end cap 300 comprises a first spring loaded switching element 302 and a second spring loaded switching element 304. The second spring loaded switching element 304 is accessible from the side of the end cap 300. The first switching element 302 protrudes at two positions at a connection end 322 of a housing portion 306 of the end cap 300 in the vicinity of connector pins 116. In further embodiments, the first switching element 302 may protrude at one position, or at more than two positions, at the connection end 322. According to the depicted embodiment in FIG. 3*a*, the first switching element 302 cannot be depressed and thereby actuated unless the second switching element 304 is depressed and thereby actuated. In a non-actuated state of the second switching element 304, a side portion 316 of the second switching element 304 is in abutment with a wall portion 308 of the housing portion 306. Hereby, the first switching element 302, which is in connection with the second switching element 304, is prevented from being actuated.

Figure 3B:
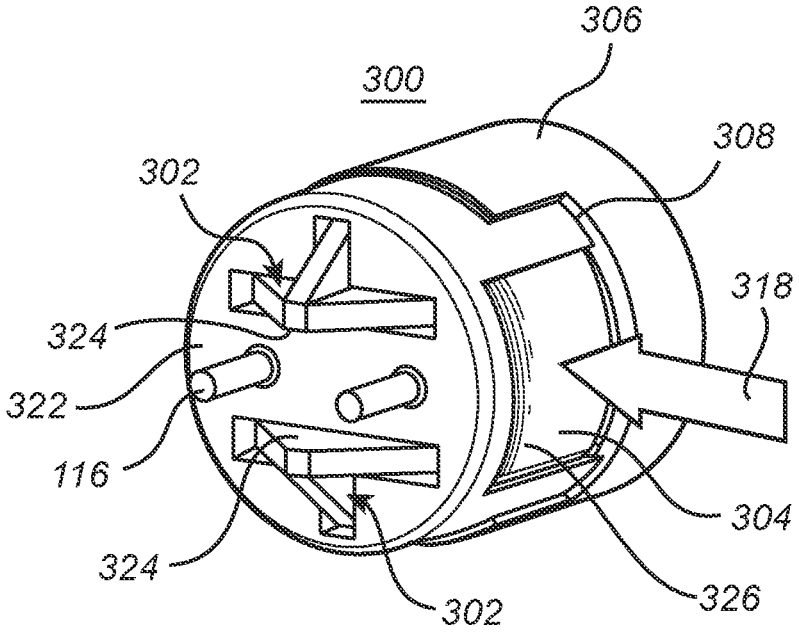

In FIG. 3*b*, the second switching element 304 is depressed by applying a translational force, indicated by the arrow 318, to a front portion 326 of the switching element 304 by for example an installer of a connected tubular light source. By depressing the second switching element 304, the first switching element 302 is no longer prevented from being actuated.

Figure 3C:
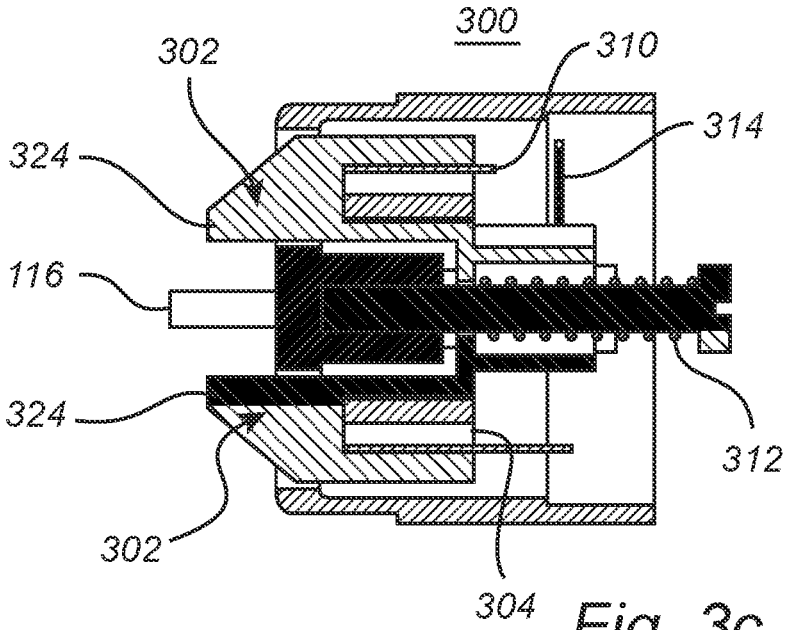
Figure 3D:
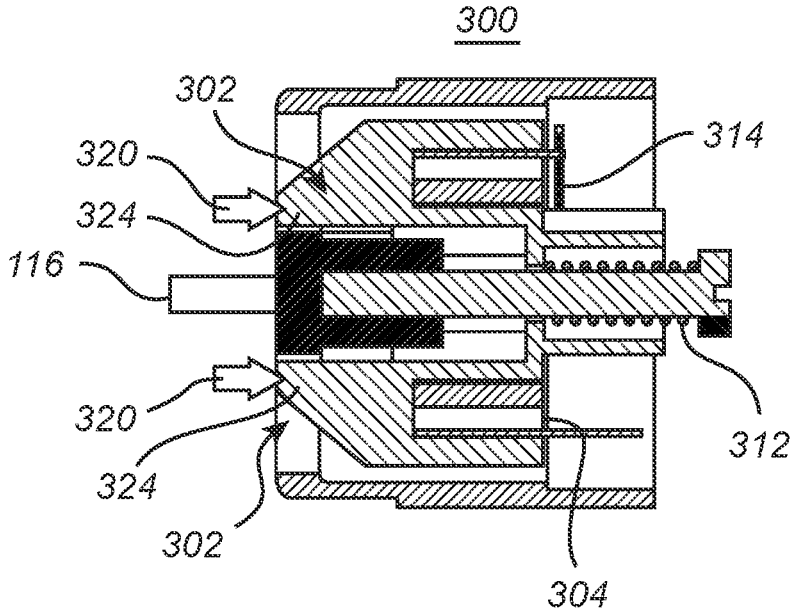

FIG. 3*c* shows a cross section of the end cap of FIG. 3*b*. The connector pins 116 are configured to form an electrical contact with a conducting receiving means 314 via a conducting transmitting means 310, the connector pins being in contact with the conducting transmitting means 310. The conducting transmitting means 310 and the first switching element 302 are interrelated and thus moving at the same time and direction. As shown in FIG. 3*c*, no electrical contact is made when the first switching element 302 is not yet depressed. FIG. 3*d* shows a cross section of the end cap 300 in an actuated state. In FIG. 3*d*, the first spring loaded switching element 302 is depressed by applying a translational force, depicted by the arrows 320, to a front portion 324 of the first switching element 302, while the second spring loaded switching element 304 is depressed, i.e. in an actuated state. The actuation of the first 302 and second 304 switching elements is thus done sequentially. The arrow shaped configuration of the first switching elements 302, best seen in FIGS. 3*a* and 3*b*, transforms an applied non-translational force onto the first switching element 302 into a translational force which in turn will actuate the first switching element 302. When the first switching element 302 is being depressed, the interrelated conducting transmitting means 310 is moving towards the conducting receiving means 314 and finally, when the first switching element 302 is fully depressed and thereby actuated, forms an electrical connection between the connector pins 116 and the conducting receiving means 314.

When the first switching element 302 is depressed, for example when mounting a tubular light source comprising the end cap 300 in an intended fixture, the housing portion 306 will keep the second switching element 304 depressed, thereby allowing the installer to stop applying manual pressure to the second switching element 304 when the first switching element 302 is in the actuated state. Furthermore, the two switching elements 302, 304 are, in the depicted example embodiment, individually operated, e.g. the installer cannot depress both elements 302, 304 by one finger at the same time. This reduces the risk of the installer accidentally depressing both switching elements.

The first switching element 302 is spring loaded by means of a spring 312. The second switching element 304 is spring loaded by means of a spring or a suitable resilient material (not shown). The springs 312 may be coil springs, leaf springs, elastic elements or any similar structure. By using a spring loaded switching element 302, the switching element 302 is returned to its non-actuated position as soon as no pressure is applied to it. As described above, the second switching element 304 is kept in its actuated state as long as the first switching element 302 is in its actuated state. If the first switching element 302 is not actuated, the second switching element 304 is returned to its non-actuated position as soon as no pressure is applied to it.

Figure 4:
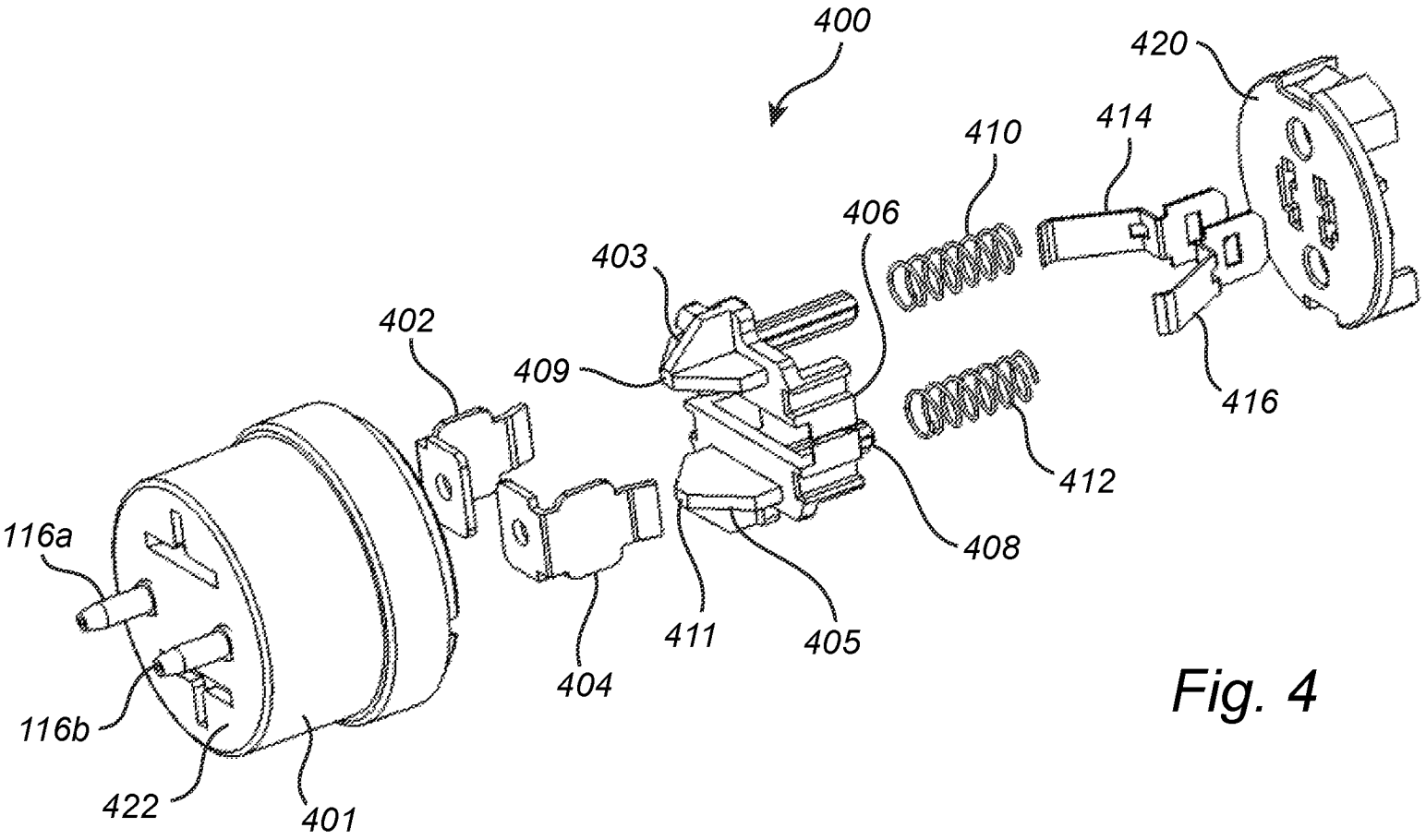
FIG. 4 schematically illustrating an exploded view of an end cap for a tubular light source according to an embodiment of the invention.

FIGS. 4 to 11 illustrating, by way of example, an end cap 400 according to an embodiment of the present invention. The example embodiment will now be described with reference to FIG. 4 showing an exploded view of the end cap 400.

The end cap 400 comprises a housing portion 401 wherein two electrically conductive connector pins 116*a-b*, which are adapted to fit into the socket 108, are arranged so that a portion of the connector pins 116*a-b* are protruding from the outside of the housing portion 401 through openings in the housing portion 401. Each connector pin 116*a-b* is connected to a fixed tongue 402, 404 on an inside of the housing portion 401; the tongues 402, 404 are made of a conductive material such as a metal. The fixed tongues 402, 404 have a hole for receiving an inner part of the respective connector pin 116*a-b*. Each fixed tongue 402, 404 is essentially L-shaped, but the part furthest away from the connected pin 116*a-b* is bent slightly outwards, away from a center longitudinal axis of the end cap 400.

The end cap further comprising a switching element unit arranged to fit within the fixed tongues 402, 404. The switching element unit comprises two separate spring loaded switching elements 403, 405 having an actuated and a non-actuated state. The spring loaded switching elements 403, 405 are arranged to protrude from the outside of the housing portion 401 through openings in the housing portion 401 in a non-actuated state. Each switching element 403, 405 comprise a first and a second separating element 406, 408, 423, 424. Each separating element 406, 408, 423, 424 is adapted to abut an upper part of the corresponding fixed tongue 402, 404, i.e. close to the corresponding connector pin, when the corresponding switching element 403, 405 is in a non actuated state. The separating elements 406, 408, 423, 424 are made of a non-conducting material such as a plastic material. Each switching element 403, 405 is actuated by applying a translational force onto a front portion 409, 411 of the switching element 403, 405. This will in turn move the corresponding first and second separating element 406, 408, 423, 424 in a direction along the center longitudinal axis of the end cap 400. This in turn will make the separating element 406, 408, 423, 424 to abut outwardly bent part of the corresponding fixed tongue 402, 404, as will be described in conjunction with FIGS. 8 and 10 below. The end cap 400 further comprises a base plate 420 to which two resilient tongues 414, 416 are fastened. The resilient tongues 414, 416 are made of a conductive material such as copper or any other suitable conductive material. The base plate 420 may be made of any non conductive material such as a plastic material. The resilient tongues 414, 416 are shaped to abut on a corresponding fixed tongue 402, 404 unless at least one of the switching elements 403, 405 is in its non actuated state. In this case the corresponding separating elements 406, 408, 423, 424 will separate the fixed tongues 402, 404 from the resilient tongues 414, 416 and thus force the resilient tongues 414, 416 towards the center longitudinal axis of the end cap 400. The resilient tongues 414, 416 will in this case be tensioned.

The switching elements 403, 405 are spring loaded by means of a spring 410, 412. By using spring loaded switching elements the switching elements 403, 405 are returned to their, non-actuated, rest position as soon as no pressure is applied to them. The springs 410, 412 of the switching elements 403, 405 may be coil springs, leaf springs, elastic elements or any similar structure. The shape of the separating elements 406, 408, 423, 424 and the resilient tongues 414, 416 are adapted such that the separating element 406, 408, 423, 424 will force the resilient tongues 414, 416 away from the corresponding fixed tongue 402, 404 when the switching element 403, 405 comprising the separating elements 406, 408, 423, 424 is changing state from actuated to non-actuated as described above.

The arrow shaped configuration of the switching elements 403, 405 transforms an applied non-translational force onto the switching element 403, 405 into a translational force which in turn will actuate the switching element 403, 405. The housing portion 401 of the end cap 400 can be made of plastic or metal having an electrical insulation.

Figure 5:
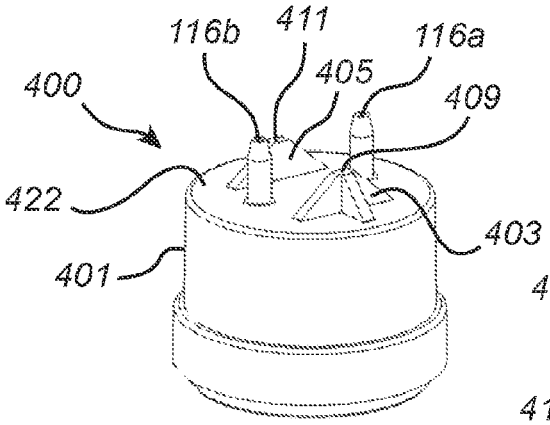
FIG. 5 shows a perspective view of an end cap of FIG. 4, wherein both spring loaded switching elements are in a non-actuated state.
Figure 6:
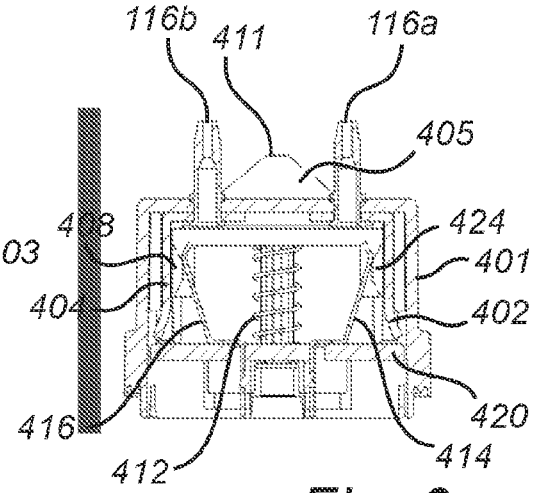
FIG. 6 shows a cross section of the end cap of FIG. 5.

FIG. 5 shows by way of example a perspective view of the end cap 400. In FIG. 5, both spring loaded switching elements 403, 405 are in a non-actuated state and thus protruding from the housing portion 401 of the end cap at the connection end 422. The arrow shaped configuration of the switching elements 403, 405 described above is clearly visible. In a further embodiment, the edges of the front portions 409, 411 of the switching elements 403, 405 are made sharp, which may further reduces the risk of having an installer accidently actuating the switching element 403, 405 manually since the sharp edges may cause pain to the installer if she/he manually pushes the front portion 409, 411. FIG. 6 shows a cross section of the end cap of FIG. 5. The left resilient tongue 416 are abutting, or resting on, the first separating element 408 of the switching element 405 and the first separating element 406 (not shown) of the switching elements 403. Consequently, the left resilient tongue 416 is separated from the left fixed tongue 404. The right resilient tongue 414 are abutting, or resting on, the second separating element 424 of the switching element 405 and the second separating element 423 (not shown) of the switching elements 403. Consequently, the right resilient tongue 414 is separated from the right fixed tongue 402.

Figure 7:
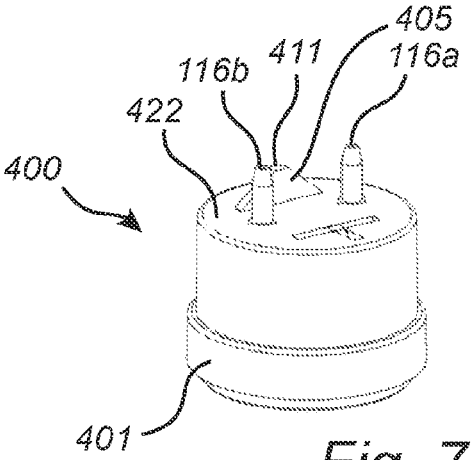
FIG. 7 shows a perspective view of an end cap of FIG. 4, wherein one spring loaded switching element is in an actuated state.
Figure 8:
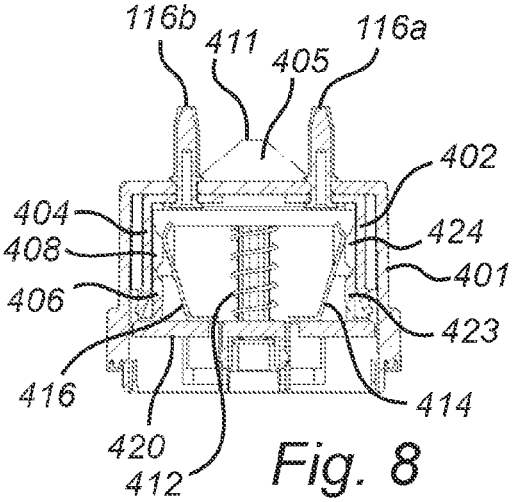
FIG. 8 shows a cross section of the end cap of FIG. 7.

In FIG. 7, one switching element 403 is being depressed and thus actuated. The effect of this is shown in FIG. 8 which is a cross section of the end cap of FIG. 7. The first and the second separating element 406, 423 belonging to the actuated switching element 403 are thus moved in a direction along the center longitudinal axis of the end cap 400 and abutting the outwardly bent part of the fixed tongues 402, 404. The left resilient tongue 416 are still abutting, or resting on, the first separating element 408 of the non-actuated switching element 405. Consequently, the left resilient tongue 416 is still separated from the left fixed tongue 404. The right resilient tongue 414 are still abutting, or resting on, the second separating element 424 of the non-actuated switching element 405. Consequently, the right resilient tongue 414 is still separated from the right fixed tongue 402. The double safety mechanism of this embodiment of the invention is thus clearly visualized in FIG. 8.

Figure 9:
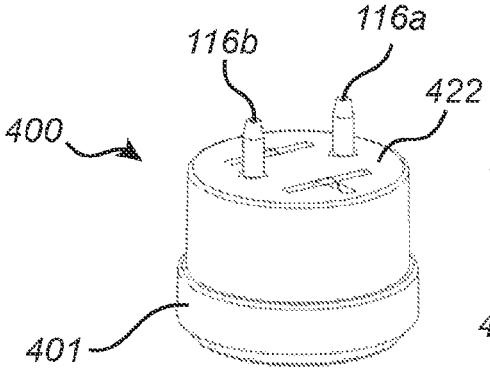
FIG. 9 shows a perspective view of an end cap of FIG. 4, wherein both spring loaded switching elements are in an actuated state.
Figure 10:
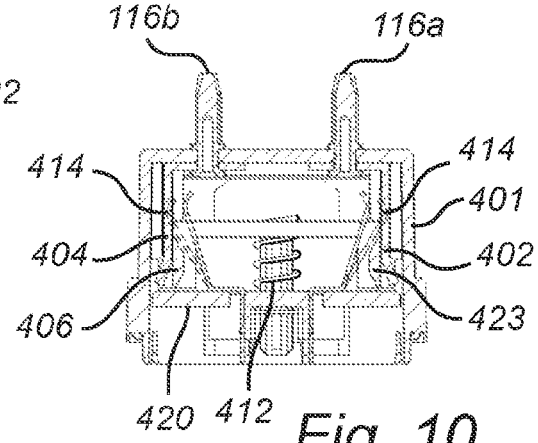
FIG. 10 shows a cross section of the end cap of FIG. 9.

In FIG. 9, both switching elements 403, 405 are being depressed and thus actuated. The effect of this is shown in FIG. 10 which is a cross section of the end cap of FIG. 9. Since both switching elements 403, 405 are actuated; all separating elements 406, 408, 423, 424 are in a direction along the center longitudinal axis of the end cap 400 and abutting the outwardly bent part of the fixed tongues 402, 404. Consequently, none of the separating elements 406, 408, 423, 424 is no longer abutting the fixed tongues 402, 404 at a position where the upper part of the resilient tongues 414, 416 are adapted to contact the corresponding fixed tongue 402, 404. As can be seen in FIG. 10, the tension in the resilient tongues 414, 416 makes them move towards the corresponding fixed tongue 402, 404 and end up resting against it. Consequently, a conductive path between the resilient tongues 414, 416 and the connector pins 116*a-b* are closed.

Figure 11:
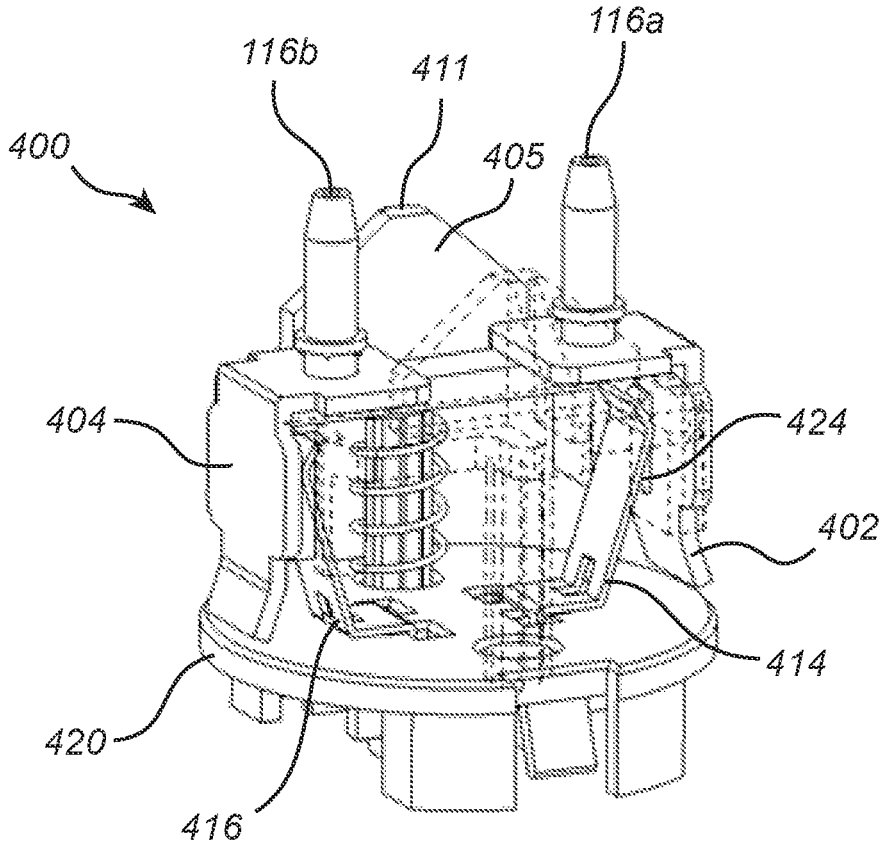
FIG. 11 shows a perspective view of and end cap of FIG. 4 with some portions merely indicated by dashed lines.

FIG. 11 shows by way of example a perspective view of and end cap 400 of FIG. 4 with some portions merely indicated by dashed lines and wherein the housing portion have been removed. In FIG. 11, the functionality of separating elements are clearly visible. The resilient tongue 414 is resting towards the separating element 424 and the separating element 423 (not shown). The resilient tongue 416 is resting towards the separating element 408 (not shown) and the separating element 406 (not shown). Consequently, the resilient tongue 416 is separated from the fixed tongue 404 and the resilient tongue 414 is separated from the fixed tongue 402. Consequently, a conductive path between the resilient tongues 414, 416 and the connector pins 116*a-b* are open.

Thus, the end cap 400 is arranged as a duplicated protection. If just one of the switching elements 403, 405 is pushed down, the two conductive paths between the resilient tongues 414, 416 and the connector pins 116*a-b* are open. Only when both switching elements 403, 405 are pushed down at the same time, the two conductive paths between the resilient tongues 414, 416 and the connector pins 116*a-b* are closed.

The person skilled in the art realizes that the present invention by no means is limited to the preferred embodiments described above. On the contrary, many modifications and variations are possible within the scope of the appended claims. For example, the end cap 104, 300, 400 may comprise further spring loaded switching elements that needs to be actuated before an electrical connection between the socket and the tubular light source is formed when the end cap is mounted into the socket of the fixture. Such a possible further switching element may be actuated by relative rotational motion of the housing portion in relation to the tubular light source.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The invention claimed is:

1. An end cap for a tubular light source, the tubular light source configured to be arranged in a lighting fixture comprising a socket, wherein the end cap comprises:

a housing portion having a connection end;

two connector pins at least partly arranged on an outside of the housing portion at the connection end, wherein the connector pins are configured to fit in the socket of the lighting fixture;

a first spring loaded switching element configured to be alternately positioned in an actuated state and a non-actuated state, wherein the first spring loaded switching element protrudes at the connection end of the housing portion when positioned in its non-actuated state; and a second spring loaded switching element configured to be positioned in an actuated state and a non-actuated state, a bridging element coupled between the first spring loaded switching element and the second spring loaded switching element, wherein an electrical connection is formed between the bridging element and a conductive receiving element when the first spring loaded switching element and the second spring loaded switching element are depressed into an actuated position configured to be individually positioned in their respective actuated states by means of mounting the tubular light source into the socket of the fixture, wherein the first spring loaded switching element is coupled to the second spring loaded switching element via the bridging element both when the first spring loaded switching element is in the actuated position and when the first spring loaded switching element is in a non-actuated, non-depressed position.

2. The end cap according to claim 1, wherein the first and second spring loaded switching elements are arranged in their actuated states by applying a translational force onto a front portion of the first and the second spring loaded switching element, respectively.

3. The end cap according to claim 2, wherein the first switching element is configured to return to its non-actuated state when no translational force is applied onto its front portion.

4. The end cap according to claim 1, wherein the front portion of at least one of the switching elements has an arrow shaped configuration.

5. The end cap according to claim 1, wherein the second spring loaded switching element protrudes at the connection end of the housing portion when positioned in its non-actuated state.

6. The end cap according to claim 5, wherein the second switching element is configured to return to its non-actuated state when no translational force is applied to its front portion.

7. The end cap according to claim 1, wherein the end cap further comprising:

a first fixed tongue connected to a first of the two connector pins;

a second fixed tongue connected to a second of the two connector pins;

a base plate connected to a first and a second resilient tongue, the first resilient tongue being arranged to abut the first fixed tongue and the second resilient tongue being arranged to abut the second fixed tongue to complete a conductive path between the first resilient tongue and the first connector pin and between the second resilient tongue and the second connector pin, respectively, when both of the two spring loaded switching elements are in the actuated state;

wherein each of the two spring loaded switching elements comprising a first and a second separating element;

wherein the first and second separating elements of each of the two spring loaded switching elements, in the non-actuated state, is individually arranged to separate both the first fixed tongue from the first resilient tongue and the second fixed tongue from the second resilient tongue, respectively, thus opening the conductive path between the resilient tongues and the connector pins.

8. The end cap according to claim 1, wherein the first spring loaded switching element further comprises a lock mechanism, wherein actuation of the second spring loaded switching element unlocks the lock mechanism allowing the first spring loaded switching element to be actuated.

9. The end cap according to claim 2, wherein the electrical connection between the socket and the tubular light source is formed by actuating the second spring loaded switching element while inserting the connector pins of the tubular light source into the socket of the fixture.

10. The end cap according to claim 8, wherein de-actuating of the first spring loaded switching element de-actuates the second spring loaded switching element.

11. A tubular light source comprising:

a lighting tube comprising a plurality of light emitting elements; and the end cap according to claim 1 arranged on each ends of the lighting tube.

12. The tubular light source according to claim 11, further comprising warning means, the warning means comprising a blinking light positioned onto the at least one end cap.

13. The tubular light source according to claim 11, further comprising a relay which in combination with the switching elements enables operation of the tubular light source when mounted in the lighting fixture.

14. The tubular light source according to claim 11, further comprising a timer which in combination with the switching elements enables operation of the tubular light source when mounted in the lighting fixture.

15. A luminaire comprising:

a tubular light source according to claim 11; and a fixture comprising sockets for receiving the respective end caps and for connecting the tubular light source to an electrical power supply.

* * * * *